United States Patent [19]

Horiguchi et al.

[11] Patent Number: 4,608,829

[45] Date of Patent: Sep. 2, 1986

[54] WASTE HEAT RECOVERING DEVICE

[75] Inventors: Akira Horiguchi; Hiroyuki Sumitomo, both of Osaka, Japan

[73] Assignee: Hisaka Works, Ltd., Osaka, Japan

[21] Appl. No.: 688,941

[22] Filed: Jan. 4, 1985

[30] Foreign Application Priority Data

Jan. 5, 1984 [JP] Japan ..... 59-447
Sep. 26, 1984 [JP] Japan ..... 59-200879

[51] Int. Cl.[4] ..... F01K 27/00

[52] U.S. Cl. ..... 60/643; 418/85; 418/100; 62/83; 62/238.6; 237/12.1

[58] Field of Search ..... 62/83, 238.6; 237/12.1, 237/2 B; 418/85, 97, 100; 60/648, 673, 670, 597, 643, 644.1

[56] References Cited

U.S. PATENT DOCUMENTS 2,760,355 8/1956 Swart ..... 62/83

*Primary Examiner*—Henry Bennett

*Attorney, Agent, or Firm*—Armstrong, Nikaido, Marmelstein & Kubovcik

[57] ABSTRACT

A heat recovering device comprising an oil injection type screw expander having its output shaft connected to a load, such as a generator, an evaporator using waste heat as a heat source to evaporate a working medium so as to produce working medium vapor to be fed to the expander, a condenser for condensing the working medium vapor discharged from the expander, a working medium circulating pump for circulating the working medium within a system comprised of the condenser, evaporator and expander, an oil circulating pump for feeding oil to the expander, and a heater for heating oil to be fed to the expander to a higher temperature than the working medium vapor temperature. The device is characterized in that the heated oil is injected into the expander in such a manner that the working medium vapor and the heated oil come in direct contact with each other in the expander, thereby superheating the working medium vapor.

2 Claims, 7 Drawing Figures

WASTE HEAT RECOVERING DEVICE

BACKGROUND OF THE INVENTION

1. Field of the Invention

This invention relates to a waste heat recovering device using an oil injection type screw expander and is utilizable for recovery of waste heat discharged from plants.

2. Description of the Prior Art

A heat recovering device is known which is designed to recover heat from hot waste water and the like discharged from plants, on the basis of Rankine cycle utilizing a small temperature difference. This device comprises an evaporator using hot waste water or the like as a heat source to heat and evaporate a working medium, e.g., freon, a turbine which is rotated by the freon vapor from the evaporator, a condenser for cooling and condensing the freon vapor discharged from the turbine, and a freon circulating pump for circulating the freon through the system. The output shaft of the turbine is connected to a load such as a generator.

The drawback of this device is that because of the low temperature of hot waste water or the like which is a heat source, the working medium cannot be sufficiently heated, or a large temperature difference cannot be attained, with the result that the recovery of power cannot be effected to the fullest extent.

To offset this drawback, the freon vapor from the evaporator could be introduced into an additional heat exchanger, where it is superheated, and then supplied to the turbine, whereby an increase in the power recovery rate could be expected. In this case, however, since the freon, in its vapor state, enters the additional heat exchanger, the latter, which is used to superheat the freon vapor, must of necessity be large-sized. Therefore, a large space between the evaporator and the turbine is required for said heat exchanger, adding to the overall size of the device, a new drawback.

SUMMARY OF THE INVENTION

This invention is concerned with a heat recovering device which operates on the principle of utilizing a heat source of low temperature such as hot waste water from plants to evaporate a working medium, and recovering power by means of said working medium, and the invention is intended to increase the power recovery rate by superheating the working medium vapor, without involving an increase in the size of the device.

This invention is a heat recovering device comprising an oil injection type screw expander having its output shaft connected to such a load as a generator, an evaporator for evaporating a working medium by waste heat used as a heat source to produce working medium vapor to be fed to the expander, a condenser for condensing the working medium vapor discharged from the expander, a working medium circulating pump for circulating the working medium within a system comprised of the condenser, evaporator and expander, an oil circulating pump for feeding oil to the expander, and a heater for heating the oil fed to the expander to a higher temperature than the temperature of the working medium vapor, said device being characterized in that the hot oil is injected into the expander in such a manner that it comes in direct contact with the working medium vapor, thereby superheating the working medium vapor.

DESCRIPTION OF THE PREFERRED EMBODIMENTS

Figure 1:
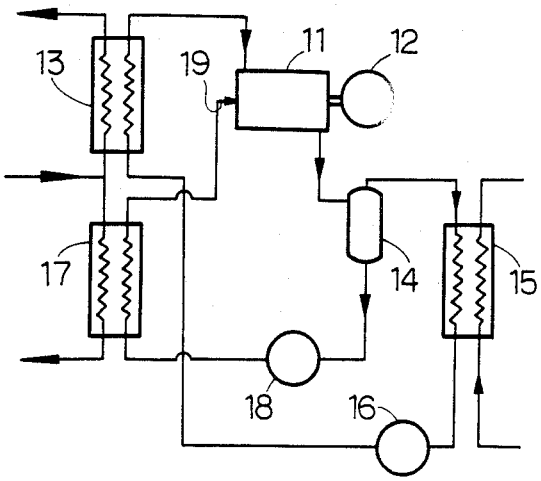
FIG. 1 is a block diagram of a heat recovering device according to an embodiment of this invention.

Embodiments of the invention shown in the drawings will now be described.

First, referring to FIG. 1, the heat recovering device uses an oil injection type screw expander 11 having its output shaft connected to a load (e.g., generator) 12. A working medium, such as freon, to be fed to said expander 11 is circulated by a working medium circulating pump 16 within a system comprised of an evaporator 13 for heating and evaporating the working medium by using hot waste water or the like as a heat source, an oil separator 14 for separating the working medium and oil discharged from said expander 11, and a condenser 15 for condensing the working medium vapor from the oil separator 14 by cooling it with cooling water. The expander 11 is also fed with oil to serve as a lubricant and a sealer as well as to superheat the working medium vapor. This oil is circulated by an oil circulating pump 18 within a system comprised of a heater 17 for heating the oil to a higher temperature than the working medium vapor temperature, expander 11 and oil separator 14. In addition, the heater 17 may have its heat source in common with the evaporator 13, as illustrated, but it may have a separate heat source.

Figure 2:
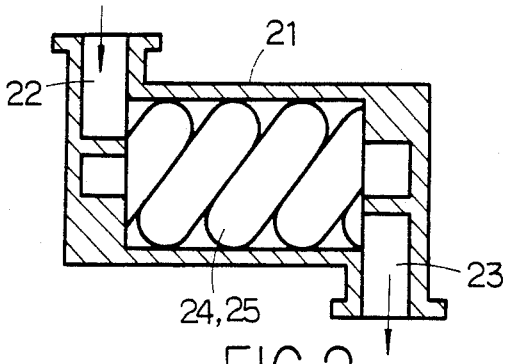
FIGS. 2–4 are a schematic longitudinal section, a schematic cross-section and a schematic perspective view, respectively, of an oil injection type screw expander.
Figure 3:
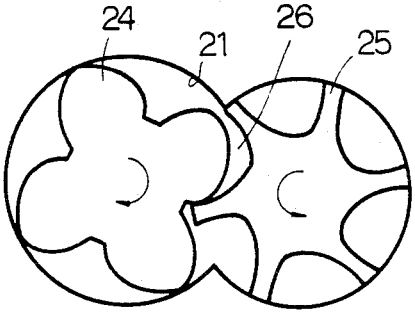
Figure 4:
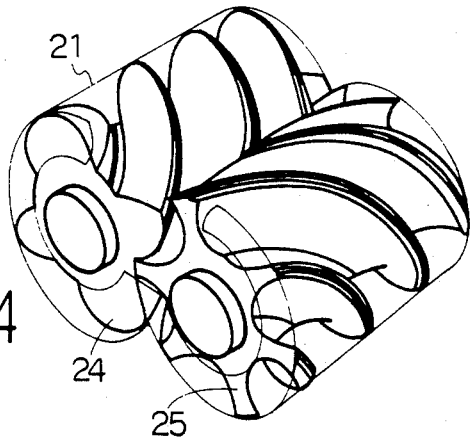

The expander 11, as shown in FIGS. 2–4, comprises a casing 21 having a suction port 22 and an exhaust port 23 for working medium, and a pair of male and female rotors 24 and 25 extending parallelly and rotatably in the casing. The rotors 24 and 25 mesh with each other to define a toothform space 26 therebetween. The configuration of the rotors 24 and 25 is such that as the toothform space 26 moves from the suction port side to the exhaust port side, its volume increases. The rotors 24 and 25 are surrounded by the casing 21 and the suction and exhaust ports 22 and 23 open toward the end surfaces of the rotors 24 and 25. Disposed at an arbitrary position in the suction port 22 is a nozzle 19 (FIG. 1) for injecting oil, which is discharged from the heater 17 and which has been heated to a higher temperature than the working medium vapor temperature, into the casing 21. The oil lubricates the male and female rotors 24 and 25 and seals the portions, as described above, and at the same time it comes in direct contact with the working medium vapor fed from the suction port 22 into the casing 21 to thereby superheat the working medium vapor.

The function of the waste heat recovering device of the above construction will now be described.

The working medium vapor fed from the evaporator 11 into the suction port 22 flows into the toothform space 26 between the rotors 24 and 25 and advances to the exhaust port 23 while expanding, thereby rotating the rotors 24 and 25. This power is transmitted to the load 12, such as a generator, through the output shaft of the expander 11.

Figure 5:
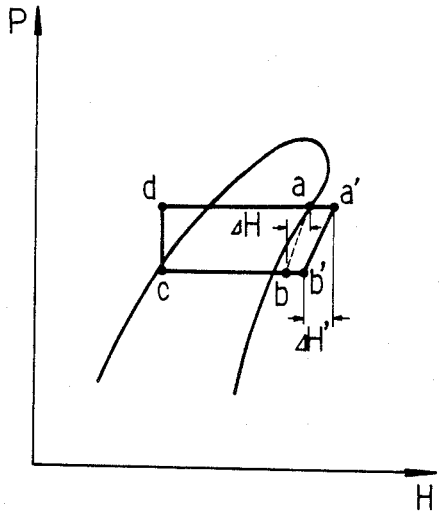
FIGS. 5 and 6 are P-H diagrams of a working medium, with pressure P plotted along the vertical axis and enthalpy H along the horizontal axis.

Further, the oil heated by the heater 17 to a higher temperature than the working medium vapor temperature is injected from the nozzle 18 installed in the casing 21 of the expander 11. Thus, the working medium vapor in the expander 11 contacts the oil of higher temperature and is thereby superheated. This will now be described with reference to the P-H diagram in FIG. 5. In this figure, a and a' indicate the states of the working medium at the working medium suction port of the expander 11 (i.e., at the outlet of the evaporator 13); b and b' indicate the states of the working medium at the working medium exhaust port of the expander 11 (i.e., at the inlet of the condenser 15); c indicates the state of the working medium at the outlet of the condenser 15; and d indicates the state of the working medium at the inlet of the evaporator 13. The thermodynamic cycle associated with the case of not superheating the working medium vapor is a→b→c→d and the power recovery rate is $\Delta H = Ha - Hb$. On the other hand, the thermodynamic cycle associated with the case of superheating the working medium, i.e., the reheating cycle, is a'→b'→c→d and the power recovery rate is $\Delta H' = Ha' - Hb'$. Thus, the relation $\Delta H'/\Delta h > 1.0$ holds. In this connection, under the conditions that the working medium vapor temperature is 60° C. at the inlet of the expander 11 and 30° C. at the outlet thereof, if the working medium vapor is superheated by 20° by oil injection, $\Delta H'/\Delta H = 1.1$; thus, an increase of about 10% in the power recovery rate is attained.

Figure 7:
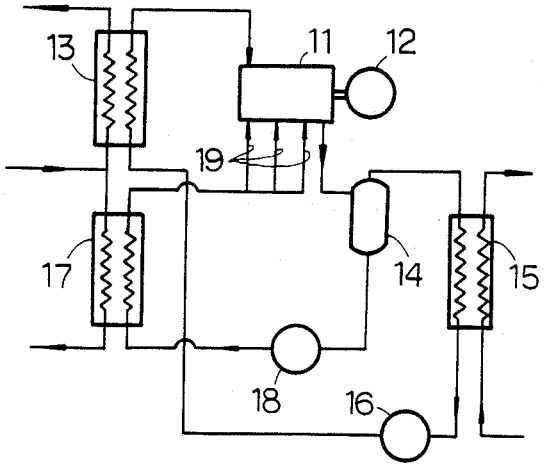
FIG. 7 is a block diagram of a heat recovering device according to another embodiment of the invention.
Figure 6:
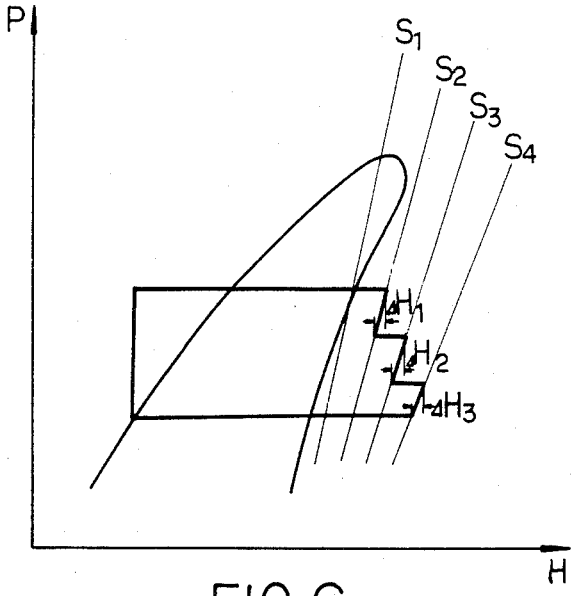

FIGS. 6 and 7 shows another embodiment wherein the working medium vapor is reheated a plurality of times, i.e., in multistage, by oil injection during its travel from the suction port 22 to the exhaust port 23 of the expander 11. To this end, nozzles 19' (FIG. 7) are disposed at suitable positions in the casing 21 so that the working medium vapor can be subjected to multistage oil injection (three stages in FIGS. 6 and 7) during its travel from the suction port 22 to the exhaust port 23 of the expander 11. In the case where reheating is effected three times by injecting the oil from the heater 17 into the working medium vapor in the expander 11, the expansion work done by the working medium vapor is expressed by $$\sum_{1}^{3} \Delta Hi.$$

Further, the gradient of isoentropic lines S1–S4 is the gentler, the more the pressure falls; thus, by injecting oil in some stages not only in the vicinity of the suction port 22 of the expander 11 but also somewhere else in the path up to the exhaust port 23, the power recovery rate is increased.

The working medium vapor and oil are discharged from the exhaust port 23 of the expander 11 and enter the oil separator 14. The working medium vapor is separated from the oil by the oil separator 14 and goes to the condenser 15. The working medium condensed by the condenser 15 is fed into the evaporator 13 by the working medium circulating pump 16. On the other hand, the oil separated from the working medium by the oil separator is fed again to the nozzle 19 or nozzles 19' of the expander 11 by the oil circulating pump 18.

According to this invention, as described above, after the working medium is evaporated by the evaporator, it is fed to the expander, while the oil to be fed to the expander, after being heated to a higher temperature than the working medium vapor temperature, is fed to the expander, whereby the working medium vapor is brought into direct contact with the oil and thereby superheated; in this manner, the power recovery rate can be increased as compared with the conventional device in which the working medium vapor is fed directly to the turbine. Further, if the working medium vapor is superheated by using liquid oil to be fed to the expander, in this manner, the power recovery rate can be increased without bulking the heat recovering device, since the heating of oil can be effected by a small-sized heater. Further, by effecting the reheating of the working medium vapor by high temperature oil injection in multistage and particularly in the vicinity of the exhaust port of the expander, the thermal efficiency is increased. Therefore, the recovery of power from waste heat even at relatively low temperatures can be attained efficiently.

What is claimed is:

1. A heat recovering device comprising an oil injection type screw expander having its output shaft connected to a load, an evaporator using waste heat as a heat source to evaporate a working medium so as to produce working medium vapor to be fed to said expander, a condenser for condensing the working medium vapor discharged from said expander, a working medium circulating pump for circulating the working medium within a system comprised of said condenser, evaporator and expander, an oil circulating pump for feeding oil to said expander, and a heater for heating the oil to be fed to the expander to a higher temperature than the working medium vapor temperature, said device being characterized in that the working medium vapor and heated oil to be fed to the expander are brought into direct contact with each other in the suction port of the expander.

2. A heat recovering device as set forth in claim 1, wherein said heated oil is injected in such a manner that the working medium vapor and oil are brought into direct contact with each other in multistage while the working medium vapor is traveling from the suction port to the exhaust port of the expander.

* * * * *